United States Patent [19]

Gladh et al.

[11] 4,323,622

[45] Apr. 6, 1982

[54] HIGH-ELASTICITY PRESS FELT

[75] Inventors: Arne I. L. Gladh, Skoghall; Eric W. Gröndahl, Halmstad, both of Sweden

[73] Assignee: Albany International Corp., Albany, N.Y.

[21] Appl. No.: 61,293

[22] PCT Filed: Nov. 21, 1978

[86] PCT No.: PCT/SE78/00080

§ 371 Date: Jul. 21, 1979

§ 102(e) Date: Jul. 17, 1979

[87] PCT Pub. No.: WO79/00312

PCT Pub. Date: Jun. 14, 1979

[30] Foreign Application Priority Data

Nov. 21, 1977 [SE] Sweden ..... 7713097

[51] Int. Cl.[3] ..... B32B 5/06

[52] U.S. Cl. ..... 428/230; 428/231; 428/234; 428/300; 428/909

[58] Field of Search ..... 428/230, 231, 234, 300, 428/909

[56] References Cited

U.S. PATENT DOCUMENTS

| | | | |
|---|---|---|---|
| 3,086,276 | 4/1963 | Bartz | 428/234 |
| 3,093,880 | 6/1963 | McLaughlin | 428/234 |
| 3,365,766 | 1/1968 | Tewksbury | 428/234 |
| 3,839,136 | 10/1974 | Eriksson | 428/234 |
| 4,107,367 | 8/1978 | Fekette | 428/234 |

*Primary Examiner*—Marion McCamish

*Attorney, Agent, or Firm*—Kane, Dalsimer, Kane, Sullivan and Kurucz

[57] ABSTRACT

A high-elasticity dewatering felt for use in e.g. papermaking and cellulose machines wherein the elastic properties of the felt are obtained by admixture thereinto of high-molecular thermoplastic elastomer materials, alternatively high-molecular cross-linked urethane-based elastomer materials, which elastomer materials are capable of stretching to at least twice their original length and subsequently, after relief of the load thereon, rapidly return to substantially their original length.

11 Claims, No Drawings

HIGH-ELASTICITY PRESS FELT

BACKGROUND OF THE INVENTION

In machines for the production of paper, paper pulp and similar products, the fibrous web is dewatered partly by being squeezed between two press rollers. For economical reasons it is generally desirable to remove the majority of the moisture of the fibrous web in the press section. In the last decades, intensive research has led to entirely new types of felts and cloths designed for dewatering purposes in the press section of paper machines. Owing to these new products, it has become possible to meet increasing demands on dewatering efficiency. At the same time, the machine speeds have become higher, with the result that the demands on the runability and wear resistance of these products also have increased.

The older type of press felts which comprised a woven, conventional product which was felted and napped has practically disappeared from the market and is replaced by needled felts. As a rule, these needled felts have a basic structure in the form of a base weave. This base weave may also be replaced by yarn material in one direction only of the two felt directions. The base structure of the needled felt may also be totally void of yarn materials. Up-to-date needled press felts usually consist of one compressible part which is positioned closest to the fibrous web that is to be dewatered, and one less compressible part which is designed to receive and carry away the water that is squeezed out of the fibrous web. When a felt of this kind is used in a papermaking machine, the same area of the felt passes the press nip several times every minute and in doing so it is exposed to a cyclic compression which is exerted in the direction of the felt thickness. In addition, the felt is gradually permanently deformed until it is reduced to a state of reduced function. Felts of today's structure furthermore are liable to damage in case e.g. lumps of pulp pass through the press nip, as the compressible felt layer lacks the elastic properties necessary to take the deformation stresses that are generated under these circumstances. Damage of this kind to the press felt or to the batt thereof often occurs in the form of a razor-sharp slit in the crosswise direction of the felt, and the appearance of the slit suggests that the felt breaks on account of a very high, localized tensile stress that is exerted in the longitudinal felt direction. By increasing the thickness of the felt it is possible to increase the total compression without affecting the less compressible felt part. Although the result is that localized compression may be earier taken by the felt without damaging the cloth, it does, however, also bring about the disadvantage of reducing the openness and rendering water through-flow more difficult. The increased proportion of the batt included in the compressible part of the felt also increases the plastic deformation of the felt, which means an increase of the successive reduction of the permeability and at the same time increased risks of damage.

SUMMARY OF THE INVENTION

The subject invention aims at eliminating this drawback by incorporating into the needled felt high-molecular elastomer materials which lend themselves to stretching to at least twice their original length and thereafter, when the load on them ceases, rapidly resume substantially their original length. The elastomer material should possess such properties that it imparts to the felt the necessary resilience during the entire serviceable life of the felt, also under the extremely severe conditions caused by high machine speeds and high squeezing pressures.

DETAILED DESCRIPTION OF THE INVENTION

Attempts have earlier been made to mix rubber materials into woven conventional dryer felts and wet felts. However, these attempts have been limited to conditions that do not meet today's demands on machine speeds and squeezing pressures. The earlier used rubber materials have proved unsuitable for use in the manufacture of needled felts. During the manufacturing operation of such needled felts the barbs of the needles penetrate through the batt and the base weave to anchor the batt fibres directly or indirectly to the base weave. This exposes the fibrous material to considerable mechanical stress. Ordinary rubber materials are immediately torn into pieces by the needle barbs. In addition, the conventional rubber materials have a comparatively low initial module which makes them unsuitable for use in connection with the high machine speeds and operational tensions that are characteristic of modern papermaking machines. Furthermore, conventional rubber materials have limited resistance to the effects of ozone and oxidation. These materials age comparatively rapidly in the environment prevailing in papermaking machines.

Instead, in accordance with the teachings of the subject invention, high-molecular thermoplastic elastomers or urethane-based conventional elastomers are used. Thermoplastic elastomers are materials that do not need to be cross-linked. The materials soften upon temperature increases and may easily be worked in the manner of conventional thermoplastic resins, e.g. be extruded into fibrous materials. Of the thermoplastic elastomers above all those of polyurethane and polyester types have proved suitable for the purpose in accordance with the invention. Also cross-linked urethane-based elastomers meet the requirements that are put on materials intended for use in felts that are applied on modern papermaking machines. These materials possess excellent mechanical properties and good chemical stability. The elastomers may be stretched to at least twice their original length and rapidly resume their original length, or near original length, when the load on them is subsequently relieved. A normal value of the elasticity of the material is that after having been stretched to double its original length it returns to 5% or less permanent elongation in approximately 5 seconds after the load on it is removed. This does not, however, exclude that elastic materials with properties deviating from this general value may be considered suitable for felts in accordance with the invention.

More precisely, the subject invention thus is concerned with a dewatering felt for use in the press section of papermaking machines, cellulose machines and similar machines, which felt is characterised in that it comprises high-molecular thermoplastic elastomer materials which are capable of being stretched to at least twice their original length and after relief of the load thereon, rapidly resume substantially their original length.

In accordance with another aspect of the subject invention, the felt comprises high-molecular cross-linked urethane-based elastomer materials which are capable of being stretched to at least twice their length and thereafter, after relief of the load thereon, rapidly resume substantially their original length.

The dewatering felt in accordance with the invention has a conventional base. The latter may in the usual manner consist of a woven press felt or cloth but preferably of a needled felt with or without a base weave. The batt part of the needled felt may consist of one or several layers of varying fibre fineness. This conventional base structure includes, in accordance with the teachings of the invention high-molecular elastomers in such quantities as to affect significantly the elastic properties of the felt.

Examples of various applications of the invention:

I. As the base weave of a needled felt woven endless in a four-shaft pattern so as to form a double-layer structure including two layers in the weft direction, i.e. the machine direction. One of these layers consists of yarns comprising a core of an elastomer polyurethane filament about which is spun a polyamide thread. The second weft layer of the base weave consists of multifilaments or monofilaments and its warp or crosswise yarns consist of monofilaments, none of them being highly elastic materials. The weight of the base weave is calculated to 750 g/m$^2$ of which the high-elastic material is appr. 120 g/m$^2$. On top of the base weave is needled a batt having a surface weight of 450 g/m$^2$ and comprising a mixture of polyamide fibres of 6 and 15 deniers.

II. The same structure of the base weave and the batt as in the aforegoing Example, except that the polyurethane filament about which is spun a polyamide thread is replaced by a filament, also in this case of an elastic polyurethane but having no thread spun about it. In this case the weight of the base weave is calculated to 750 g/m$^2$, of which the elastomer materials is appr. 200 g/m$^2$.

III. A base weave woven endless in a four-shaft, single-layer structure wherein every other thread in the warp as well as in the weft consists of elastic polyurethane monofilaments alone or having other yarns spun about them. Every other machine direction thread consists of a twisted monofilament thread and every other crosswise thread of a single monofilament. The weight of the base weave is calculated to 400 g/m$^2$ of which the elastomer material is appr. 200 g/m$^2$. On top of the base weave is preferably needled a bat corresponding to the one mentioned in Example I.

IV. A base weave woven endless in a four-shaft, single-layer structure wherein the machine direction threads are twisted monofilaments and the crosswise threads are single monofilaments. On top of this base weave is needled a batt having a surface weight of 700 g/m$^2$ and comprising to 80% polyamide fibres of 6 and 15 deniers and to 20% highly elastic fibrous materials.

In the above Examples the elastomer material consists of threads or of fibrous material. The material may also be included as one component of the bicomponent fibres.

Elastomer materials of polyurethane of conventional cross-linked type as well as of thermoplastic type have proved to be very suitable for mixing into dewatering felts in accordance with the subject invention. However, also other high-molecular thermoplastic elastomer materials may be used. As examples hereof may be mentioned styrene-based polymers, olefine-based polymers and ester-based polymers.

The elastic properties of the felt are affected by the quantity of elastomer materials that is included into its basic structure. Already small quantities admixed thereto may give measurable physical changes. To achieve optimum effect it is, however, necessary that a certain proportion of elastomer material is included. It has been found that the admixture in the base weave should amount to at least 15% of the weight of the base weave and to at least 10% of the total weight of the felt.

The use of thermoplastic elastomer materials and cross-linked urethane-based elastomer materials in dewatering felts has several advantages over prior-art conventional products. Because of the increased elastic properties of the felt the latter resumes its original shape more easily after each passage through a press nip in addition to which its successive, permanent deformation is decreased. The felt therefore retains its openness over a longer period of time. The ability of the felt to resume its original shape after deformation also diminishes the risks of damage, e.g. in case a lump of pulp enters the press nip. The elastic material of the felt in these cases take the deformation stress and resumes its original shape, when the pulp lump has passed the nip. Modern high-speed paper machines are very sensitive to vibrations. The admixture of elastic materials into the dewatering felt has a vibration-dampening effect on the entire press section of the machine. Because it is possible to keep the felt in accordance with the invention more open, it is also easier to keep it clean. The increased elasticity of the felt in addition brings about the advantage of providing wider press nips and consequently longer squeeze times.

The product in accordance with the invention as described above and defined in the appended claims is referred to as a "dewatering felt". This concept is intended to include also other types of machine cloths used for dewatering purposes.

What is claimed is:

1. A dewatering felt of needled textile fibre material for use in the press section of paper-making machines, cellulose machines and similar machines, characterised in that said material comprises high-molecular thermoplastic elastomer fibres which may be stretched to at least twice their original length and thereafter, after relief of the load thereon, rapidly return to essentially their original length.

2. A dewatering felt as claimed in claim 1, characterised in that the thermoplastic elastomer fibres are urethane-based polymers.

3. A dewatering felt as claimed in claim 1, characterised in that the thermoplastic elastomer fibres are ester-based polymers.

4. A dewatering felt as claimed in claim 1, characterised in that the thermoplastic elastomer fibres are styrene-based polymers.

5. A dewatering felt as claimed in claim 1, characterised in that the thermoplastic fibres are olefine-based polymers.

6. A dewatering felt as claimed in any of the preceding claims characterised in that the elastomer fibres form threads.

7. A dewatering felt as claimed in claim 6, characterised in that the elastomer fibres are included as one component of bicomponent fibres.

8. A dewatering felt as claimed in claim 1, comprising a batt and base structure characterised in that the elastomer material is included in the batt of the needled felt.

9. A dewatering felt as claimed in claim 1, comprising a batt and a base structure characterised in that the elastomer material is included in the base structure of the needled felt.

10. A dewatering felt as claimed in claim 1, comprising a batt and a base structure, characterised in that the elastomer material of the base structure of the felt amounts to at least 15 percent by weight of the base structure and to at least 10 percent by weight of the total weight of the felt.

11. A dewatering felt of needled textile fibre material for use in the press section of paper-making machines, characterised in that said material comprises high-molecular cross-linked urethane-based elastomer fibres which are capable of being stretched to at least twice their length and thereafter, after relief of the load thereon, rapidly return to substantially their original length.

* * * * *